US009335703B1

(12) United States Patent
Link

(10) Patent No.: US 9,335,703 B1
(45) Date of Patent: May 10, 2016

(54) AUDIO DETECTION OF MEDIUM JAM

(71) Applicant: Kodak Alaris Inc., Rochester, NY (US)

(72) Inventor: Bruce Link, Rochester, NY (US)

(73) Assignee: Kodak Alaris Inc., Rochester, NY (US)

( * ) Notice: Subject to any disclaimer, the term of this patent is extended or adjusted under 35 U.S.C. 154(b) by 0 days.

(21) Appl. No.: 14/579,764

(22) Filed: Dec. 22, 2014

Related U.S. Application Data

(60) Provisional application No. 62/064,858, filed on Oct. 16, 2014.

(51) Int. Cl.

| | |
|---|---|
| ***B65H 7/06*** | (2006.01) |
| ***B65H 3/06*** | (2006.01) |
| ***B65H 5/06*** | (2006.01) |
| ***G03G 15/00*** | (2006.01) |

(52) U.S. Cl.
CPC ..... *G03G 15/70* (2013.01); *B65H 7/06* (2013.01); *B65H 2511/528* (2013.01); *B65H 2515/82* (2013.01); *B65H 2553/30* (2013.01)

(58) Field of Classification Search
CPC ..... B65H 2553/30; B65H 2511/528; B65H 2515/82; B65H 7/06; G03G 15/70
See application file for complete search history.

(56) References Cited

U.S. PATENT DOCUMENTS

| | | | | |
|---|---|---|---|---|
| 4,463,607 | A | 8/1984 | Hilton | |
| 7,828,279 | B2 | 11/2010 | Hammen | |
| 8,857,815 | B2 | 10/2014 | Hongo et al. | |
| 8,955,840 | B2 * | 2/2015 | Shimazu | 271/258.01 |
| 2004/0100018 | A1 | 5/2004 | Phinney et al. | |
| 2013/0093136 | A1 * | 4/2013 | Sakharshete et al. | 271/258.01 |
| 2014/0054850 | A1 | 2/2014 | Umi et al. | |
| 2014/0061995 | A1 | 3/2014 | Shimazu | |
| 2014/0251016 | A1 | 9/2014 | Adams, Jr. et al. | |

FOREIGN PATENT DOCUMENTS

JP 57169767 A * 10/1982

OTHER PUBLICATIONS

International Search Report dated Mar. 7, 2016 in corresponding PCT application No. PCT/US15/56004.

* cited by examiner

*Primary Examiner* — Luis A Gonzalez
(74) *Attorney, Agent, or Firm* — Hogan Lovells US LLP

(57) ABSTRACT

A method of indicating a medium jam along a medium transport path; a plurality of microphones for detecting the sound of the medium being transported as it enters medium transport path and producing a signal representing the sound; a plurality of microphones for detecting the sound of the medium being transported in the medium transport path and producing a signal representing the sound in the medium transport; a plurality of microphones for detecting the sound of the medium being existing the medium transport path and producing a signal representing the sound of the medium existing the medium transport; a processor for producing sound values from the signal and computing the maximum sound responsive to the sound values per each microphone, and indicating the medium jam responsive to the sound values.

20 Claims, 14 Drawing Sheets

AUDIO DETECTION OF MEDIUM JAM

CROSS-REFERENCE TO RELATED APPLICATIONS

This application claims the benefit of U.S. Provisional Application No. 62/064,858, filed Oct. 16, 2014, and hereby incorporates by reference the provisional application in its entirety.

BACKGROUND OF THE INVENTION

The sound a sheet of hardcopy media makes as it moves along a hardcopy media transport path can be used to diagnose the condition of the hardcopy media. Quiet or uniform sounds can indicate a normal or problem-free passage of the hardcopy media along the hardcopy media transport path. Loud or non-uniform sounds can indicate a disruption in the passage of the sheet of hardcopy media such as a stoppage due to jamming or tearing or other physical damage of the hardcopy media.

As an example, in commonly assigned U.S. Pat. No. 4,463,607 a hardcopy media transport cylinder with a specialized profile is used to enhance the diagnostic qualities of the hardcopy media transport noise in order to detect hardcopy media wear. However, this specialized hardcopy media transport cylinder is designed to induce stresses into the hardcopy media that interfere with smooth hardcopy media transport at high transport speeds.

Other known methods of detecting jams include using optical or mechanical sensors in order to detect the times of the passage of a sheet of hardcopy media at various locations along the hardcopy media transport path. If the hardcopy media does not arrive at a given location at a given amount of time after the start of transport, a hardcopy media jam is inferred. The problem with this approach is that optical and mechanical sensors are highly localized in physical detection range, requiring the use of several such sensors situated along the hardcopy media transport path.

Commonly assigned U.S. Pat. No. 8,857,815 describes placing a microphone near the beginning of a hardcopy media feed path in order to detect the sound of a hardcopy media jam in progress. The signal from the microphone is processed by counting the number of sound samples above a given threshold within a sampling window of a given width. If the count is sufficiently large a hardcopy media jam is signaled. In this approach, no information is provided about the location of the hardcopy media as it moves along the transport path. Thus, although sound may be used to detect a jam in progress, information regarding the location of the jam that may be provided by optical or mechanical sensors as discussed above is unavailable.

There remains a need for a fast and robust technique to indicate hardcopy media jams along a hardcopy media transport path that uses a single hardcopy media sensor and processes the signals from the hardcopy media sensor simply, and in a way that incorporates the location of the hardcopy media along the hardcopy media transport path.

SUMMARY OF THE INVENTION

The present invention represents a method of indicating a medium jam along a medium transport path in a scanner or other media transport device. The scanner includes one or more rollers for use in conveying the medium along the medium transport path. One or more microphones are included in the scanner and detect the sound of the medium being transported. The microphones produce signals representing the sound, which are sent to a processor which produces sound values from the signals. Various sound amplitude maximum values are computed, including a pre-transport path maximum amplitude values responsive to the sound values from a plurality of microphones from a region before the medium transport path, transport path maximum amplitude values responsive to the sound values from a plurality of microphones from a region within the medium transport path, and post-transport path maximum amplitude values responsive to the sound values from a plurality of microphones from a region after the medium transport path. The processor analyzes these various computed sound values and indicates a medium jam responsive to the maximum amplitude values when the computed sound values go above what is expected for normal operation.

The processor may be included in a computer system that is part of, or in communication with, the scanner and microphones. The processor may execute computer program instructions stored on a non-transitory computer-readable medium which cause the processor to acquire sound signals from the plurality of microphones responsive to the sound generated by a medium being transported along a medium transport in the scanner. The computer-readable medium includes further instructions enabling the processor to determine whether a jam has occurred based on the sound signal values according to a detection method, as described in detail below.

Based on the sound signals received, the computer may change the detection method on-the-fly. For example, depending on where the sound values come from within a sound profile established from signals from the various microphones, loudness thresholds for indicating a jam may be adjusted.

The one or more microphones can detect the sound of a medium jamming over a larger physical area than optical or mechanical methods, which are localized in nature. As a result, one microphone can replace the need for several optical or mechanical sensors. By using multiple microphones, a larger area can be monitored and signals from the multiple microphones can be compared against each other to determine the location of the sound source better than one microphone could. Determining the location of the noise source may be helpful in determining the location of the jam, as it is typical for the jam to cause the detected noise, and thus the noise source is often the jam location. Additionally, the area covered by any one microphone depends on sound path from the sound source to the microphone, and structural features could block sound from reaching the microphone. Further, there could be noisy components such as the rollers that make it hard to decipher the sound beyond the roller. Thus, to provide full jam detection coverage, multiple microphones may be installed along the transport path. The sound values over the entire medium transport path and at specific locations along the medium transport path are processed, thereby improving medium jam detection accuracy and reliability. The sound value processing is simple as it comprises computing sums of the sound values produced from the microphone signals. More computationally intensive methods such as transformations into frequency space or signal processing methods such as median filtering are avoided, resulting in sound value processing that requires substantially less computation resources and processing time. In addition, training and calibration techniques may be applied in order to optimize and simplify parameter settings.

DETAILED DESCRIPTION OF THE INVENTION

The present invention is directed to a media transport system, and in particular to a system and method for detecting media jams within the media transport system. The method may be carried out using a process stored as instructions on a computer program product. The computer program product can include one or more non-transitory, tangible, computer readable storage medium, for example; magnetic storage media such as magnetic disk (such as a floppy disk) or magnetic tape; optical storage media such as optical disk, optical tape, or machine readable bar code; solid-state electronic storage devices such as random access memory (RAM), or read-only memory (ROM); or any other physical device or media employed to store a computer program having instructions for controlling one or more computers to practice the method according to the present invention.

Figure 1:
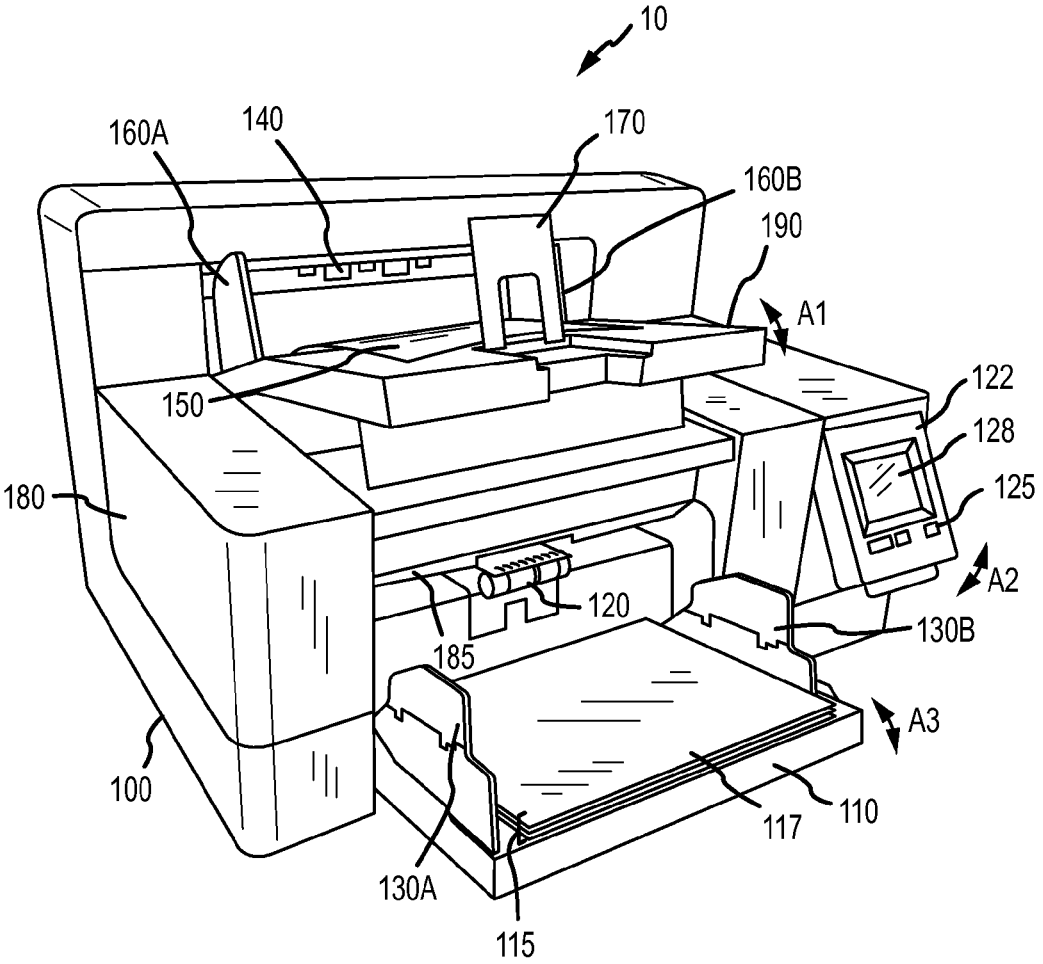
FIG. 1 is a high-level diagram showing the components of an imaging scanner.

FIG. 1 shows a medium transport system 10 in the form of a document scanner that includes a scanner base 100, a scanner pod 180, an input tray 110, an output tray 190, and an operator control panel 122. The scanner pod 180 covers the top surface of the medium transport system 10 and connects to the scanner base 100 with hinges. The hinges allow the document scanner to be opened and closed when there is a media jam within the scanner or when the medium transport system 10 needs to be cleaned.

The input tray 110 is connected to the scanner base 100 with hinges, allowing the input tray 110 to be opened and closed as illustrated by an arrow A3. The input tray 110 may be opened at times of scanning and closed when the medium transport system 10 is not in use. When the input tray 110 is closed the footprint of the medium transport system 10 can be reduced. The input tray 110 allows hardcopy media 115 to be scanned to be placed into it. Examples of the hardcopy media are paper documents, photographic film, and magnetic recording media. Other examples of the hardcopy media 115 will be evident to those skilled in the art. The top hardcopy medium 117 is the medium at the top of the hardcopy media 115 and is the next document to be pulled into the scanner by the urging roller 120. The input tray 110 is provided with input side guides 130*a* and 130*b* which can be moved in a direction perpendicular to a transport direction of the hardcopy media 115. By positioning the side guides 130*a* and 130*b* to match with the width of the hardcopy media 115, it is possible to limit the movement of the hardcopy media 115 in the input tray 110 as well as set the position (left, right or center justified) of the top hardcopy medium 117 within the media transport path. The input side guides 130*a* and 130*b* may be referred to collectively as the input side guides 130. The input tray 110 may be attached to a motor (not shown) that causes the input tray 110 to raise top hardcopy medium 117 to the urging roller 120 for scanning or to lower the input tray 110 to allow additional hardcopy media 115 to be added to the input tray 110.

The output tray 190 is connected to the scanner pod 180 by hinges, allowing the angle of the output tray 190 to be adjusted as shown by the arrow marked A1. The output tray 190 is provided with output side guides 160*a* and 160*b* which can be moved in a direction perpendicular to a transport direction of the hardcopy media 115, that is, to the left and right directions from the transport direction of the hardcopy media 115. By positioning the output side guides 160*a* and 160*b* to match with the width of the hardcopy media 115, it is possible to limit the movement of the output hardcopy media 150 in the output tray 190. The output side guides 160*a* and 160*b* may be referred to collectively as the output side guides 160. An output tray stop 170 is provided to stop the top hardcopy medium 117 after being ejected from the output transport roller 140. When the output tray 190 is in the up state as shown in FIG. 1, the ejected hardcopy media is trail-edge aligned. In the down state, the ejected hardcopy media is lead-edge aligned against the output tray stop 170.

The operator control panel 122 is attached to the scanner pod 180 and can be tilted as shown by the arrow marked A2 to allow optimal positioning for the operator. An operation input 125 is arranged on the surface of the operator control panel 122, allowing the operator to input commands such as start, stop, and override. The operation input 125 may be one or more buttons, switches, portions of a touch-sensitive panel, selectable icons on a visual operator display 128, or any other selectable input mechanism. The override command may allow the operator to temporarily disable multi-feed detection, jam detection, or other features of the scanner while scanning. The operator control panel 122 also includes an operator display 128 that allows information and images to be presented to the operator. As noted above, the display 128 could include selectable icons relating to commands and operations of the media transport device. The operator control panel 122 may also contain speakers and LEDs (not shown) to provide additional feedback to the operator.

Figure 2:
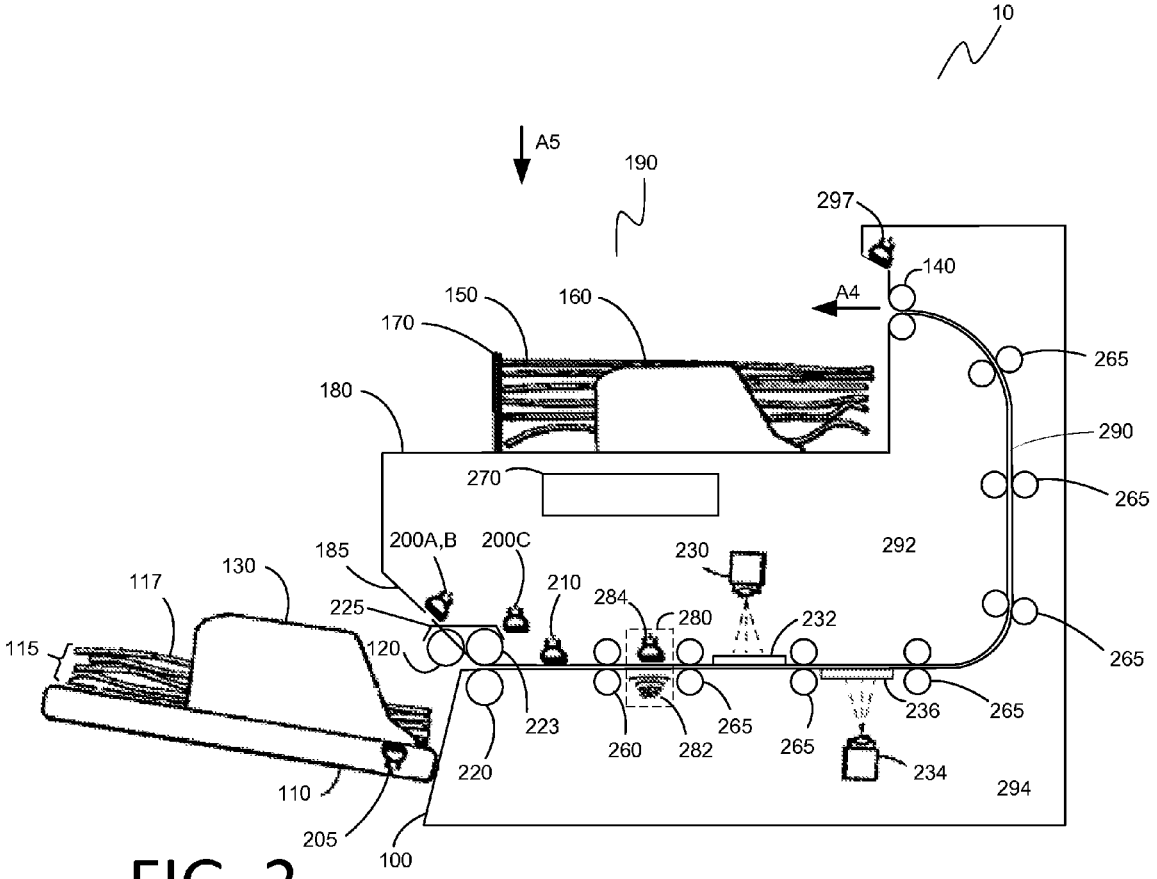
FIG. 2 is a high-level diagram showing the components of a medium transport system.

FIG. 2 illustrates the transport path inside of the medium transport system 10. The transport path inside of the medium transport system 10 has multiple rollers, including urging rollers 120, feed rollers 223, separator rollers 220, take-away rollers 260, transport rollers 265, and an output transport roller 140. The urging rollers 120 and feed roller 223 may be referred to collectively as the feed module 225. Microphones 200*a*, 200*b*, 200*c*, a first media sensor 205, a second media sensor 210, an ultrasonic transmitter 282, and an ultrasonic receiver 284 are positioned along the media transport path 290 to sense media and conditions within the media transport path 290 as the top hardcopy medium 117 is transported through the system. A pod image acquisition unit 230 and a base image acquisition unit 234 are included to capture images of the media.

The top surface of the scanner base 100 forms a lower media guide 294 of the media transport path 290, while the bottom surface of the scanner pod 180 forms and upper media guide 292 of the media transport path 290. A delta wing 185 may be provided which helps to guide the media from the input tray into the media transport path 290. As shown in FIG. 2, the delta wing may be a removable section of the upper media guide 292, transitioning from the upper media guide 292 to the scanner cabinetry of the pod 180. The delta wing may be angled to allow microphones 200 A, B to point into the input tray 110, thereby improving signal pickup.

In FIG. 2, the arrow A4 shows the transport direction that the hardcopy media travels within the media transport path 290. As used herein, the term "upstream" refers a position relative to the transport direction A4 that is closer to the input tray 110, while "downstream" refers to a position relative to the transport direction A4 that is closer to the output tray 190. The first media sensor 205 has a detection sensor which is arranged at an upstream side of the urging roller 120. The first media sensor 205 may be mounted within the input tray 110, and detects if a hardcopy media 115 is placed on the input tray 110. The first media detector 205 can be of any form known to those skilled in the art including, but not limited to, contact sensors and optical sensors. The first media sensor 205 generates and outputs a first media detection signal which changes in signal value depending on whether or not media is placed on the input tray 110.

The first microphone 200*a*, second microphone 200*b*, and third microphone 200*c* are examples of sound detectors that detect the sound generated by the top hardcopy medium 117 during transport through the media transport path 290. The microphones generate and output analog signals representative of the detected sound. The microphones 200*a* and 200*b* are arranged to the left and right of the urging rollers 120 while fastened to the delta wing 185 at the front of the scanner pod 180. The microphones 200*a* and 200*b* are mounted so as to point down towards the input tray 110. To enable the sound generated by the top hardcopy medium 117 during transport of the media to be more accurately detected by the first microphone 200*a* and the second microphone 200*b*, a hole is provided in the delta wing 185 facing the input tray 110. The microphones 200*a* and 200*b* are mounted to the delta wing 185 using a vibration reducing gasket. The third microphone 200*c* is at the downstream side of the feed roller 223 and the separator roller 220 while fastened to the upper media guide 292. A hole for the third microphone 200*c* is provided in the upper media guide 292 facing media transport path 290. The microphone 200*c* is mounted in the upper media guide 292 using a vibration reducing gasket. As an example, the microphones may be MEMS microphones mounted flush to a baffle with isolator material to reduce vibration transferring from the baffle to the MEMS. By mounting the MEMS flush, the amount of internal machine noise behind the microphone that can be detected by the microphone is reduced.

The second media detector 210 is arranged at a downstream side of the feed roller 223 and the separator roller 220 and at an upstream side of the take-away rollers 260. The second media detector 210 detects if there is a hardcopy media present at that position. The second media detector 210 generates and outputs a second media detection signal which changes in signal value depending on whether hardcopy media is present at that position. The second media detector 210 can be of any form known to those skilled in the art including, but not limited to, contact sensors, motion sensor and optical sensors.

The ultrasonic transmitter 282 and the ultrasonic receiver 284, together forming an ultrasonic sensor 280, are arranged near the media transport path 290 of the top hardcopy medium 117 so as to face each other across the media transport path 290. The ultrasonic transmitter 282 transmits an ultrasonic wave that passes through the top hardcopy medium 117 and is detected by the ultrasonic receiver 284. The ultrasonic receiver then generates and outputs a signal, which may be an electrical signal, corresponding to the detected ultrasonic wave.

A plurality of ultrasonic transmitters 282 and ultrasonic receivers 284 may be used. In this situation, the ultrasonic transmitters 282 are positioned across the lower media guide 294 perpendicular to the transport direction as marked by arrow A4 while ultrasonic receivers 284 are positioned across the upper media guide 292 perpendicular to the transport direction as marked by arrow A4.

The pod image acquisition unit 230 has an image sensor, such as a CIS (contact image sensor) or CCD (charged coupled device). Similarly, the base image acquisition unit 234 has an image sensor, such as a CIS or CCD.

As the top hardcopy medium 117 travels through the media transport path 290, it passes the pod imaging aperture 232 and the base imaging aperture 236. The pod imaging aperture 232 is a slot in the upper media guide 292 while the base imaging aperture 236 is a slot in the lower media guide 294. The pod image acquisition unit 230 images the top surface of the top hardcopy medium 117 as it passes the pod imaging aperture 232 and outputs an image signal. The base image acquisition unit 234 images the bottom surface of the top hardcopy medium 117 as it passes the base imaging aperture 236 and outputs an image signal. It is also possible to configure the pod image acquisition unit 230 and the base image acquisition unit 234 such that only one surface of the top hardcopy medium 117 is imaged.

The top hardcopy medium 117 is moved along a media transport path 290 by sets of rollers. The sets of rollers are composed of a drive roller and normal force roller. The drive roller is driven by a motor which provides the driving force to the roller. The normal force roller is a freewheeling roller that provides pressure to capture the top hardcopy medium 117 between the drive roller and normal force roller. In the medium transport system 10, the initial drive and normal force rollers that grab the top hardcopy medium 117 within the media transport path 290 are referred to as take-away rollers 260. The additional drive and normal force roller pairs along the media transport path 290 are referred to as transport rollers 265. The roller may be driven by a single motor where all the rollers start and stop together. Alternatively the rollers may be grouped together where each group is driven by its own motor. This allows different motor groups to be started and stopped at different times or run at different speeds.

The medium transport system 10 may have an output transport roller 140. The output transport roller 140 is connected to a separate drive motor that either speeds-up the top hardcopy medium 117 or slows down the top hardcopy medium 117 for modifying the way the output hardcopy media 150 is placed into the output tray 190, as described in detail in U.S. Pat. No. 7,828,279.

Hardcopy media 115 placed on the input tray 110 is transported between the lower media guide 294 and the upper media guide 292 in the transport direction shown by arrow A4 by rotation of the urging roller 120. The urging roller 120 pulls the top hardcopy medium 117 out of the input tray 110 and pushes it into the feed roller 223. The separator roller 220 resists the rotation of the feed roller 223 such that when the input tray 110 has a plurality of hardcopy media 115 placed on it, only the top hardcopy medium 117 which is in contact with the feed roller 223 is selected for feeding into the media transport path 290. The transport of the hardcopy media 115 below the top hardcopy medium 117 is restricted by the separator roller 220 to prevent feeding more than one medium at a time which is referred to as a multi-feed.

The top hardcopy medium 117 is fed between the take-away rollers 260 and is transported through the transport rollers 265 while being guided by the lower media guide 294 and the upper guide 292. The top hardcopy medium 117 is sent past the pod image acquisition unit 230 and the base image acquisition unit 234 for imaging. The top hardcopy medium 117 is then ejected into the output tray 190 by the output transport roller 140. In addition to microphones 200*a*, 200*b*, and 200*c*, a microphone 297 may be provided near the exit of the transport path. This microphone 297 detects the sounds of the hardcopy media towards the end of the transport path, and as the media is output into the output tray 190. These detected sounds may be used to detect jams occurring in the output tray 190 or as documents are exiting the media transport device. A system processing unit 270 monitors the state of the medium transport system 10 and controls the operation of the medium transport system 10 as described in more detail below.

Although FIG. 2 shows the urging roller 120 above the stack of hardcopy media 115 to select the top hardcopy media 117, in a feeding configuration often referred to as a top feeding mechanism, other configurations may be used. For example, the urging roller 120, feed roller 223 and separator roller 220 can be inverted such that the urging roller select the hardcopy media at the bottom of the hardcopy media stack 115. In this configuration microphone 200*a* and 200*b* may be moved into the scanner base 100.

Figure 3:
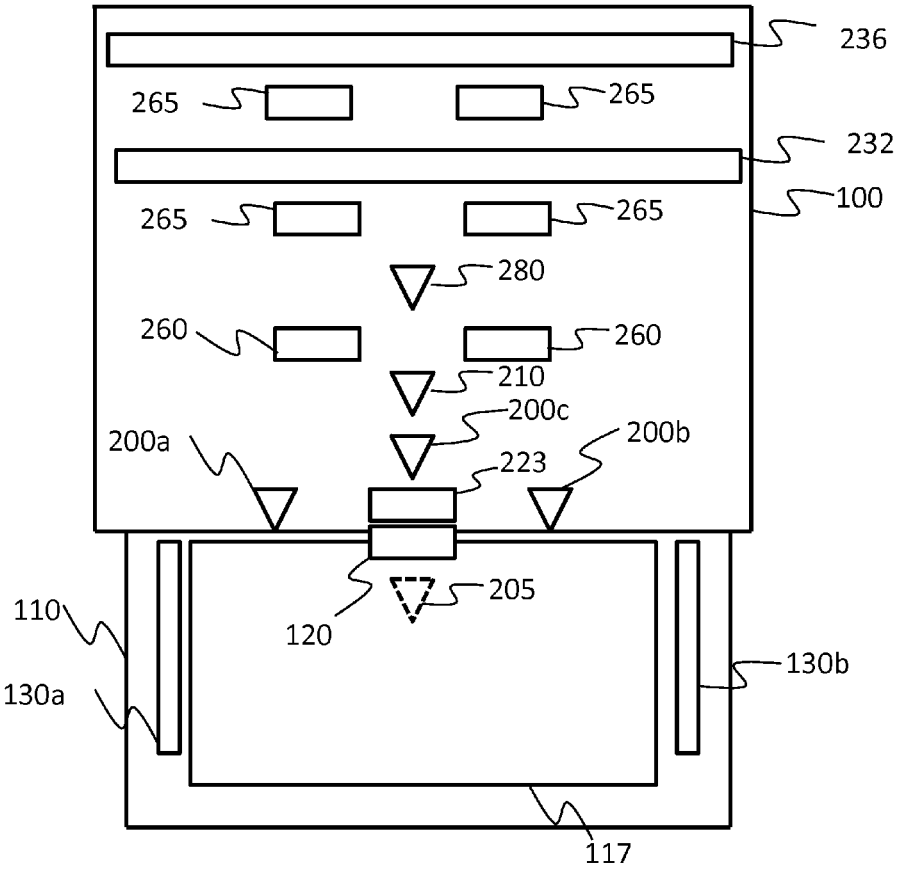
FIG. 3 is a high-level diagram showing a flattened view of the components of a medium transport system.

FIG. 3 is a block diagram of the medium transport system 10 as seen from the viewpoint shown by the direction arrow A5 in FIG. 2. As shown in FIG. 3, the first microphone 200*a* is provided to the left of the urging roller 120 and feed rollers 223 along the delta wing 185. The second microphone 200*b* is provided to the right of the urging roller 120 and feed rollers 223 along the delta wing. The placement of microphones 200*a* and 200*b* capture sound from the top hardcopy medium 117 as it is being urged into the feed roller 223 by the urging roller 120. The third microphone 200*c* is preferably located slightly behind and downstream of the feed rollers 223. The placement of microphone 200*c* captures sound from the top hardcopy medium 117 as it passes the feed roller 223 and before reaching the take-away rollers 260.

Figure 4A:
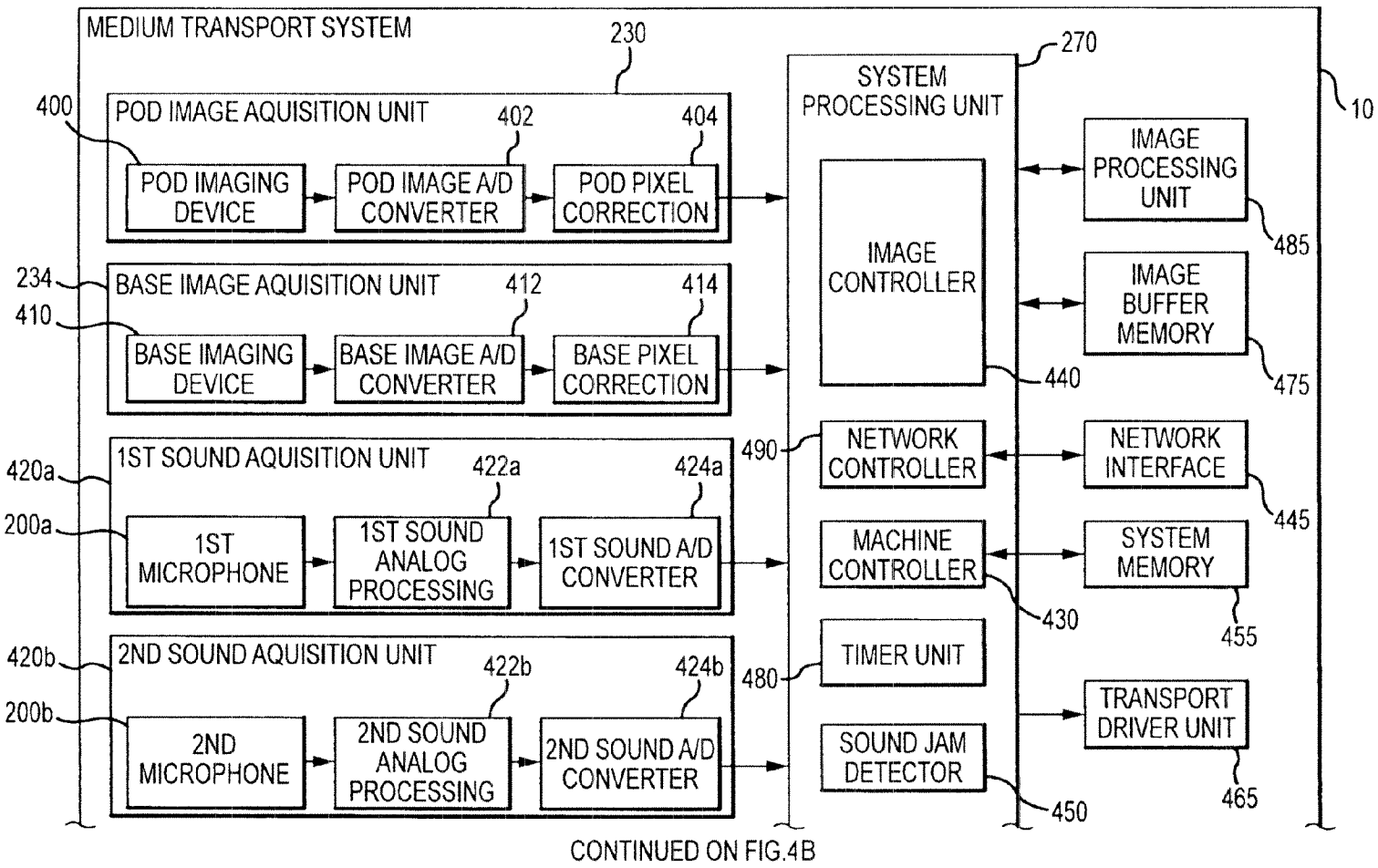
FIGS. 4A-4B are an example of a block diagram which shows the general configuration of a medium transport system.
Figure 4B:
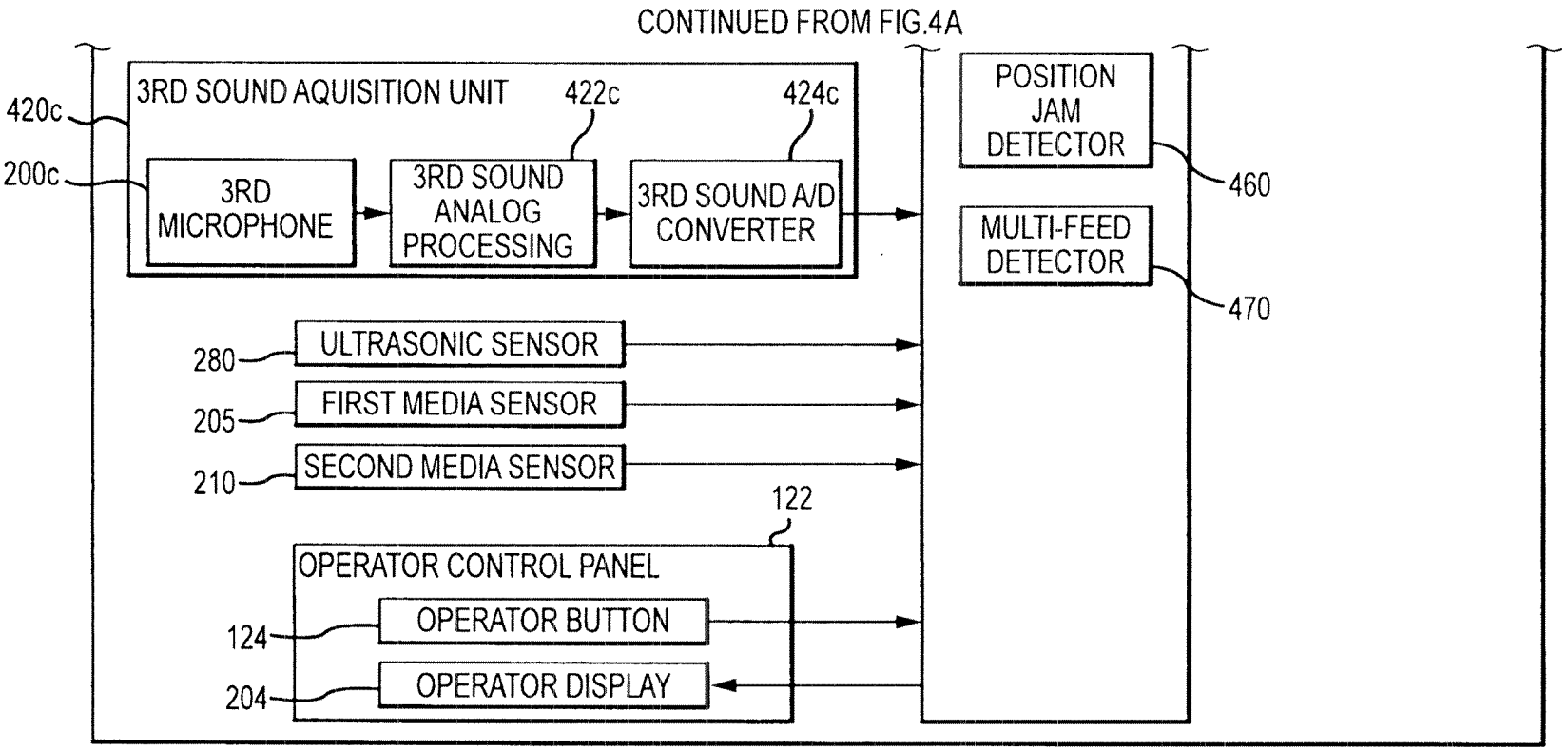

FIGS. 4A-4B are an example of a block diagram which shows the schematic illustration of a medium transport system 10. As shown, FIG. 4B is a continuation of the block diagram from FIG. 4A. The pod image acquisition unit 230 is further composed of a pod image device 400, pod image A/D converter 402 and pod pixel correction 404. As noted above, the pod image device 400 has a CIS (contact image sensor) of an equal magnification optical system type which is provided with an image capture element using CMOS (complementary metal oxide semiconductors) which are arranged in a line in the main scan direction which is perpendicular to the media transport path 290 as shown by arrow A4. As noted above, instead of a CIS, it is also possible to utilize an image capturing sensor of a reduced magnification optical system type using CCD's (charge coupled devices). The pod imaging A/D converter 402 converts an analog image signal which is output from the pod image device 400 to generate digital image data which is then output to the pod pixel correction 404. The pod pixel correction 404 corrects for any pixel or magnification abnormalities. The pod pixel correction 404 outputs the digital image data to the image controller 440 within the system processing unit 270. The base image acquisition unit 234 is further composed of a base image device 410, base image A/D converter 412 and base pixel correction 414. The base image device 410 has a CIS (contact image sensor) of an equal magnification optical system type which is provided with an image capture element using CMOS's (complementary metal oxide semiconductors) which are arranged in a line in the main scan direction. As noted above, instead of a CIS, it is also possible to utilize an image capturing sensor of a reduced magnification optical system type using CCD's (charge coupled devices). The base imaging A/D converter 412 converts an analog image signal which is output from the base image device 410 to generate digital image data which is then output to the base pixel correction 414. The base pixel correction 414 corrects for any pixel or magnification abnormalities. The base pixel correction 414 outputs the digital image data to the image controller 440 within the system processing unit 270. Digital image data from the pod image acquisition unit 230 and the base image acquisition unit 234 will be referred to as captured images.

The operator configures the image controller 440 to perform the required image processing on the captured images either through the operator control panel 122 or network interface 445. As the image controller 440 receives the captured images, it sends the captured images to the image processing unit 485 along with a job specification that defines the image processing that should be performed on the captured images. The image processing unit 485 performs the requested image processing on the captured images and outputs processed images. It will be understood that the functions of image processing unit 485 can be provided using a single programmable processor or by using multiple programmable processors, including one or more digital signal processor (DSP) devices. Alternatively, the image processing unit 485 can be provided by custom circuitry (e.g., by one or more custom integrated circuits (ICs) designed specifically for use in digital document scanners), or by a combination of programmable processor(s) and custom circuits.

The image controller 440 manages image buffer memory 475 to hold the processed images until the network controller 490 is ready to send the processed images to the network interface 445. The image buffer memory 475 can be internal or external memory of any form known to those skilled in the art including, but not limited to, SRAM, DRAM, or Flash memory. The network interface 445 can be of any form known to those skilled in the art including, but not limited to, Ethernet, USB, Wi-Fi or other data network interface circuit. The network interface 445 connects the medium transport system 10 with a computer or network (not shown) to send and receive the captured image. The network interface 445 also provides a means to remotely control the medium transport system 10 by supplying various types of information required for operation of the medium transport system 10. The network controller 490 manages the network interface 445 and directs network communications to either the image controller 440 or a machine controller 430.

A first sound acquisition unit 420*a* includes the first microphone 200*a*, a first sound analog processing 422*a*, and a first sound A/D Converter 424*a*, and generates a sound signal responsive to the sound picked up by the first microphone 200*a*. The first sound analog processing 422*a* filters the signal which is output from the first microphone 200*a* by passing the signal through a low-pass or band-pass filter to select the frequency band of the interest. The first sound analog processing 422*a* also amplifies the signal and outputs it to the first sound A/D converter 424*a*. The first sound A/D converter 424*a* converts the analog signal which is output from the first sound analog processing 422*a* to a digital first source signal and outputs it to the system processing unit 270. As described herein, outputs of the first sound acquisition unit 420*a* are referred to as the "left sound signal". The first sound acquisition unit 420*a* may comprise discrete devices or may be integrated into a single device such as a digital output MEMS microphone.

A second sound acquisition unit 420*b* includes the second microphone 200*b*, a second sound analog processing 422*b*, and a second sound A/D Converter 424*b*, and generates a sound signal responsive to the sound picked up by the second microphone 200*b*. The second sound analog processing 422*b* filters the signal which is output from the second microphone 200*b* by a passing the signal through a low-pass or band-pass filter to select the frequency band of the interest. The second sound analog processing 422*b* also amplifies the signal and outputs it to the second sound A/D converter 424*b*. The second sound A/D converter 424*b* converts the analog signal which is output from the second sound analog processing 422*b* to a digital second source signal and outputs it to the system processing unit 270. As described herein, outputs of the second sound acquisition unit 420*b* outputs will be referred to as the "right sound signal". The second sound acquisition unit 420*b* may comprise discrete devices or may be integrated into a single device such as a digital output MEMS microphone.

A third sound acquisition unit 420*c* includes the third microphone 200*c*, a third sound analog processing 422*c*, and a third sound A/D Converter 424*c*, and generates a sound signal responsive to the sound picked up by the third microphone 200*c*. The third sound analog processing 422*c* filters the signal which is output from the third microphone 200*c* by a passing the signal through a low-pass or band-pass filter to select the frequency band of the interest. The third sound analog processing 422*c* also amplifies the signal and outputs it to the third sound A/D converter 424*c*. The third sound A/D converter 424*c* converts the analog signal which is output from the third sound analog processing 422*c* to a digital third source signal and outputs it to the system processing unit 270. As described herein, outputs of the third sound acquisition unit 420*c* outputs will be referred to as the "center sound signal". The third sound acquisition unit 420*c* may comprise discrete devices or may be integrated into a single device such as a digital output MEMS microphone.

Below, the first sound acquisition unit 420*a*, second sound acquisition unit 420*b* and the third sound acquisition unit 420*c* may be referred to overall as the sound acquisition unit 420.

The transport driver unit 465 includes one or more motors and control logic required to enable the motors to rotate the urging roller 120, the feed roller 223, the take-away rollers 260, and the transport rollers 265 to transport the top hardcopy medium 117 through the media transport path 290.

The system memory 455 has a RAM (random access memory), ROM (read only memory), or other memory device, a hard disk or other fixed disk device, or flexible disk, optical disk, or other portable storage device. Further, the system memory 455 stores a computer program, database, and tables, which are used in various control function of the medium transport system 10. Furthermore, the system memory 455 may also be used to store the captured images or processed images.

The system processing unit 270 is provided with a CPU (central processing unit) and operates based on a program which is stored in the system memory 455. The system processing unit 270 may be a single programmable processor or may be comprised of multiple programmable processors, a DSP (digital signal processor), LSI (large scale integrated circuit), ASIC (application specific integrated circuit), and/or FPGA (field-programming gate array). The system processing unit 270 is connected to the operator button 124, the operator display 128, first media sensor 205, second media sensor 210, ultrasonic sensor 280, pod image acquisition unit 230, base image acquisition unit 234, first sound acquisition unit 420*a*, second sound acquisition unit 420*b*, third sound acquisition unit 420*c*, image processing unit 485, image buffer memory 475, network interface 445, system memory 455, transport driver unit 465.

The system processing unit 270 controls the transport driver unit 465, controls the pod image acquisition unit 230 and base image acquisition unit 234 to acquire a captured image. Further, the system processing unit 270 has a machine controller 430, an image controller 440, a sound jam detector 450, a position jam detector 460, and a multi-feed detector 470. These units are functional modules which are realized by software operating on a processor. These units may also be implemented on independent integrated circuits, a microprocessor, DSP or FPGA.

The sound jam detector 450 executes the sound jam detection processing. In the sound jam detection processing, the sound jam detector 450 determines whether a jam has occurred based on a first sound signal acquired from the first sound acquisition unit 420*a*, a second sound signal acquired from the second sound acquisition unit 420*b* and/or a third sound signal acquired from the third sound acquisition unit 420*c*. Situations in which the sound jam detector 450 determines that a media jam has occurred based on each signal, or a combination of signals, may be referred to as a sound jam.

The position jam detector 460 executes the position jam detection processing. The position jam detector 460 uses second media detection signals acquired from the second media sensor 210, an ultrasonic detection signal acquired from the ultrasonic detector 280 and a timer unit 480, started when the transport driver unit 465 enables the urging rollers 120 and the feed rollers 223 to feed the top hardcopy medium 117, to determine whether a jam has occurred. The position jam detector 460 can also use pod image acquisition unit 230 and base image acquisition unit 234 to detect the lead-edge and trail-edge of the top hardcopy media 117. In this case the image controller 440 outputs a lead-edge and trail-edge detection signal which is combined with the timer unit 480 to determine whether a jam has occurred if the lead-edge and trail-edge detection signal are not asserted within a predefined amount of time. Situations in which the position jam detector 460 determines that a media jam has occurred based on the second media detection signal, the ultrasonic detection signal, pod image acquisition unit 230 or base image acquisition unit 234 may be referred to as a position jam.

The multi-feed detector 470 executes multi-feed detection processing. In the multi-feed detection processing, the multi-feed detector 470 determines whether the feed module 225 has allowed multiple hardcopy media to enter the media transport path 290 based on an ultrasound signal acquired from the ultrasonic detector 280. Situations in which the multi-feed detector 470 determines that multiple hardcopy media entered the media transport path 290 may be referred to as a multi-feed.

The machine controller 430 determines whether an abnormality condition, such as a medium jam, has occurred along a media transport path 290. The machine controller 430 determines that an abnormality has occurred when there is at least one of a sound jam, a position jam, and/or a multi-feed condition. When an abnormality is detected, the machine controller 430 takes action based on the operators predefined configuration for abnormality conditions. One example of a predefined configuration would be for the machine controller 430 to inform the transport driver unit 465 to disable the motors. At the same time, the machine controller 430 notifies the user of media jam using the operator control panel 122.

When a medium jam along a media transport path 290 has not occurred, the image controller 440 causes the pod imaging acquisition unit 230 and the base imaging acquisition unit 234 to image the top hardcopy medium 117 to acquire a captured image. The pod imaging acquisition unit 230 images the top hardcopy medium 117 via the pod image device 400, pod image A/D Converter 402, and pod pixel correction 404 while the base imaging acquisition unit 234 images the top hardcopy medium 117 via the base image device 410, base image A/D converter 412, and base pixel correction 414.

Figure 5:
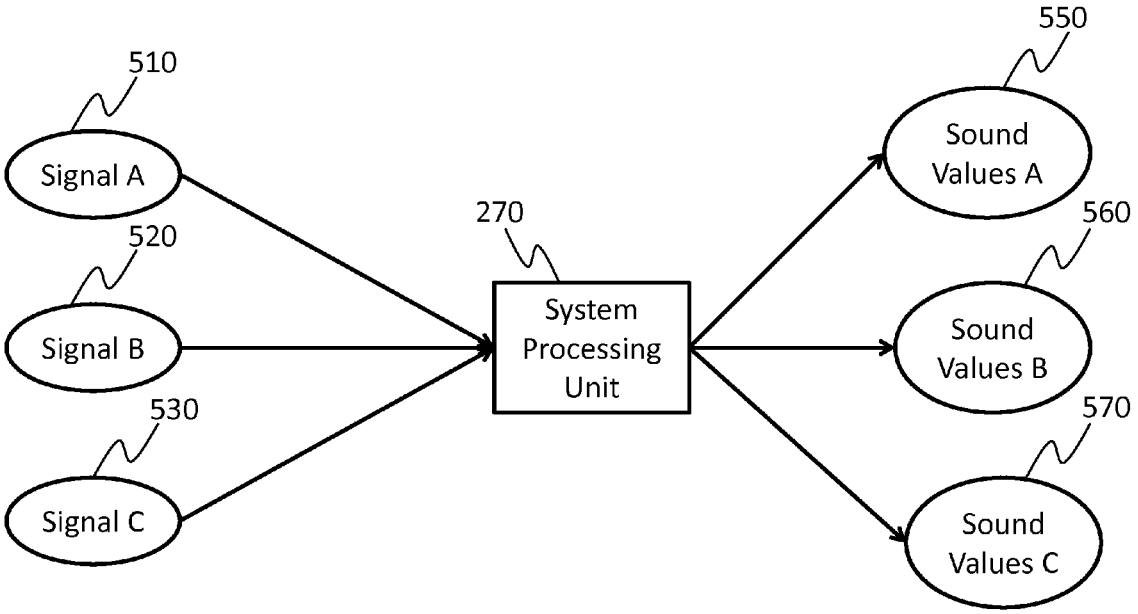
FIG. 5 is a block diagram illustrating a process for indicating a medium jam.

FIG. 5 is a block diagram of the processing for a preferred embodiment of the present invention. Microphone 200*a* detects the sound produced by the top hardcopy medium 117 along the left side of the media transport path 290 and first sound acquisition unit 420*a* produces signal A 510 representing the sound at that microphone. Microphone 200*b* detects the sound produced by the top hardcopy medium 117 along right side the media transport path 290 and second sound acquisition unit 420*b* produces signal B 520 representing the sound at that microphone. Microphone 200*c* detects the sound produced by the top hardcopy medium 117 along the center of the media transport path 290 and third sound acquisition unit 420*c* produces signal C 530 representing the sound at that microphone. Microphone 200*a*, 200*b* and 200*c* can be of any form of sensors known to those skilled in the art including, but not limited to, electromagnetic induction sensors, capacitance change sensors, and/or piezoelectric sensors. System Processing Unit 270 produces sound values A550 from signal A 510; signal values B 560 from signal B 520 and sound values C 570 from the signal C 530 which are produced by the sound acquisition unit 420.

Figure 6:
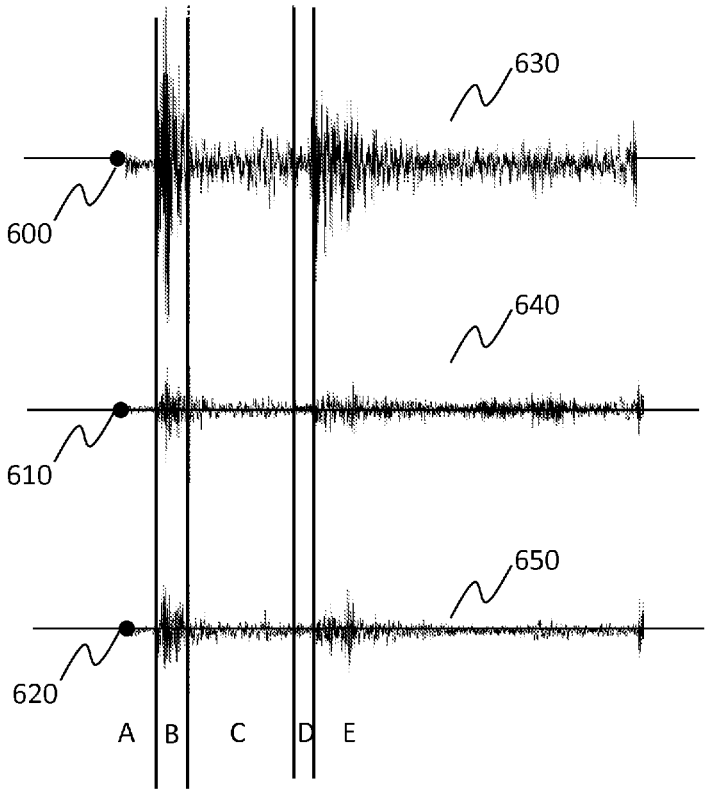
FIG. 6 is an example of the sound values in FIG. 5.

FIG. 6 is an example of a set of sound values produced by a normal passage of the top hardcopy medium 117 along the media transport path 290 at microphone 200*a*, microphone 200*b* and microphone 200*c*. Collectively the sound values A 550 represent the sound profile A 630 of the top hardcopy medium 117 captured at microphone 200*a* position. Collectively the sound values B 560 represent the sound profile B 640 of the top hardcopy medium 117 captured at microphone 200*b* position. Collectively the sound values C 570 represent the sound profile C 650 of the top hardcopy medium 117 captured at microphone 200*c* position.

Detection of the sound of the top hardcopy medium 117 begins at points 600, 610 and 620 in FIG. 6 by the microphones 200*a*, 200*b* and 200*c* respectively. Points 600, 610 and 620 mark the start of Region A in FIG. 6 and corresponds to the machine controller 430 activating the transport driver unit 465 to activate the urging roller 120 to pull the top hardcopy medium 117 towards the feed roller 223 and the separator roller 220. Region A represents the sound values captured in the delay between the machine controller 430 activating the transport driver unit 465 and the rollers actually rotating. Region B in FIG. 6 corresponds to the urging roller 120 going from being stationary to rotating and pulling the top hardcopy medium 117 into the feed roller 223 and the separator roller 220. The duration of region B is defined by the amount of time for the roller noise to dissipate into the background of the noise from the top hardcopy medium 117. Region C in FIG. 6 corresponds to the top hardcopy medium 117 being selected and pushed towards the take-away roller 260. At the end of region C, the top hardcopy medium 117 is at the ultrasonic detector 280. Region D in FIG. 6 corresponds to the top hardcopy media 115 after it passes the take-away roller 260 and ends when the transport driver unit 465 de-activates the feed module 225 to prevent additional hardcopy media 115 from entering the media transport path 290. The separator roller 220 resists the feeding of addition hardcopy media 115, if present, and the next hardcopy media 115 to come to the top of the media stack in the input tray 220 is pre-staged at the separator roller 220. Region E in FIG. 6 corresponds to the top hardcopy medium 117 in the media transport path 290 after the feed module 225 is de-activated. Additional regions could be created by using additional sensors such as the second media sensor 210 to determine the location of the top hardcopy medium 117 within the media transport path 290.

Figure 7:
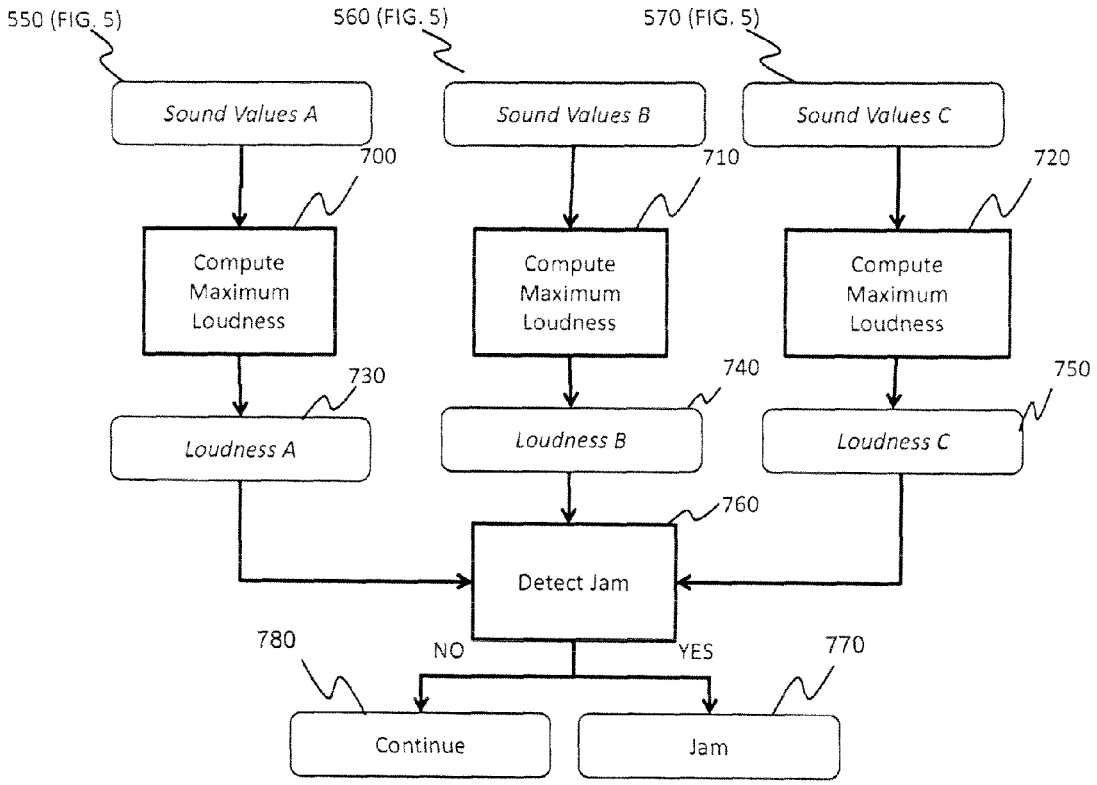
FIG. 7 is a block diagram showing additional details for the system processing unit block in FIG. 5.

A sound jam detection window is used to define the region (s) of sound values in sound profiles shown in FIG. 6 where the sound jam detector 450 executes the sound jam detection processing on the sound values looking for a sound jam. FIG. 7 is a flowchart of a sound jam detection processing portion of the preferred embodiment of the present invention. A compute maximum loudness block 700 produces loudness A 730 from the sound values A 550. A compute maximum loudness block 710 produces loudness B 740 from the sound values B 560. A compute maximum loudness block 720 produces loudness C 750 from the sound values C 570. A jam test block 760 tests the loudness A 730, loudness B 740 and loudness C 750 and produces a YES result and indicates a jam 770 if a medium jam is detected or a NO result if no jam is detected. The medium transport system continues operation 780 if a medium jam is not detected. Examples of a medium jam are stoppages of medium movement along the media transport path 290, multiple hardcopy media 115 being simultaneously fed into a media transport path 290 designed to convey only single medium of hardcopy media 115 at one time, and wrinkling, tearing, or other physical damage to the hardcopy media 115.

In FIG. 7 the compute maximum loudness block 700 computes loudness A 730 which represents how much sound was produced or the intensity of sound produced from sound values A 550. The loudness A 730 can be computed by a high amplitude count from the sounds values A 550, as described in U.S. Patent Publication No. US2014/0251016. The loudness A 730 can be represented by, for example, the maximum peak-to-peak amplitude or peak amplitude of the sound values A 550. The loudness A 730 may also be represented by any other comparison of characteristics or qualities of sound values A 550. A moving window may be used to partition the sound values A into frames that are collectively used together in the compute maximum loudness block 700. The moving window computes loudness A 730 from the most recent $N_1$ sound values A 550 within the jam detection region for sound profile A 630 where $N_1$ is typically 1024. The compute maximum loudness block 700 begins at 600 and continues until a medium jam is detected or the end of the sound values A 550 has been reached or the end of the jam detection window is reached. When the urging roller 120 and feed roller 223 initially start rotating, they produce a spike or burst of noise, as shown in region B of the sound profile A 630. This spike is referred to as mechanical noise and is due to the mechanical parts of the urging roller 120 and feed roller 223 going from stationary to a rotating motion. The compute maximum loudness block 700 ignores the sound values A 550 within region A or region B of the sound profile A 630 to avoid producing a false jam based on the mechanical noise. Alternatively the compute maximum loudness block 700 may weight the sound values A 550 within region A or region B of the sound profile A 630 to reduce the chance of producing a false jam.

The compute maximum loudness block 710 computes loudness B 740 which represents how much sound was produced or the intensity of sound produce from sound values B 560. The loudness B 740 can be computed by a high amplitude count from the sounds values B 560, as described in U.S. Patent Publication No. US2014/0251016. The loudness B 740 can be represented by, for example, the maximum peak-to-peak amplitude or peak amplitude of the sound values B 560. The loudness B 740 may also be represented by any other comparison of characteristics or qualities of sound values B 560. A moving window may be used to partition the sound values B into frames that are collectively used together in the compute maximum loudness block 710. The moving window computes loudness B 740 from the most recent $N_2$ sound values B 560 within the jam detection region for sound profile B 640 where $N_2$ is typically 1024. The compute maximum loudness block 710 begins at 610 and continues until a medium jam is detected or the end of the sound values B 560 has been reached or the end of the jam detection window is reached. When the urging roller 120 and feed roller 223 initial start rotating, they produce a spike of noise, as shown in region B of the sound profile B 640. This spike is referred to as mechanical noise and is due to the mechanical parts of the urging roller 120 and feed roller 223 going from stationary to a rotating motion. The compute maximum loudness block 710 ignores the sound values B 560 within region A or region B of the sound profile B 640 to avoid producing a false jam based on the mechanical noise. Alternatively the compute maximum loudness block 710 may weight the sound values B 560 within region A or region B of the sound profile B 640 to reduce the chance of producing a false jam.

The compute maximum loudness block 720 computes loudness C 750 which represents how much sound was produced or intensity of sound produce from sound values C 570. The loudness C 750 can be computed by a high amplitude count from the sounds values C 550, as described in U.S. Patent Publication No. US2014/0251016. The loudness C 750 can be represented, for example, by the maximum peak-to-peak amplitude or peak amplitude of the sound values C 570. The loudness C 750 may also be represented by any other comparison of characteristics or qualities of sound values C 550. A moving window may be used to partition the sound values C into frames that are collectively used together in the compute maximum loudness 720. The moving window computes loudness C 750 from the most recent $N_3$ sound values C 570 within the jam detection region for sound profile C 650 where $N_3$ is typically 1024. The compute maximum loudness block 720 begins at 620 and continues until a medium jam is detected or the end of the sound values C 570 has been reached or the end of the jam detection window is reached. When the urging roller 120 and feed roller 223 initial start rotating, they produce a spike of noise, as shown in region B of the sound profile C 650. This spike is referred to as mechanical noise and is due to the mechanical parts of the urging roller 120 and feed roller 223 going from stationary to a rotating motion. The compute maximum loudness block 720 ignores the sound values C 570 within region A or region B of the sound profile C 650 to avoid producing a false jam based on the mechanical noise. Alternatively the compute maximum loudness block 720 may weight the sound values C 570 within region A or region B of the sound profile A 650 to reduce the chance of producing a false jam.

It should be noted that compute maximum loudness block 700, 710 and 720 do not have to use the same method to compute the loudness of the sound values 550, 560 and 570. A different method may be used for each microphone.

Figure 8:
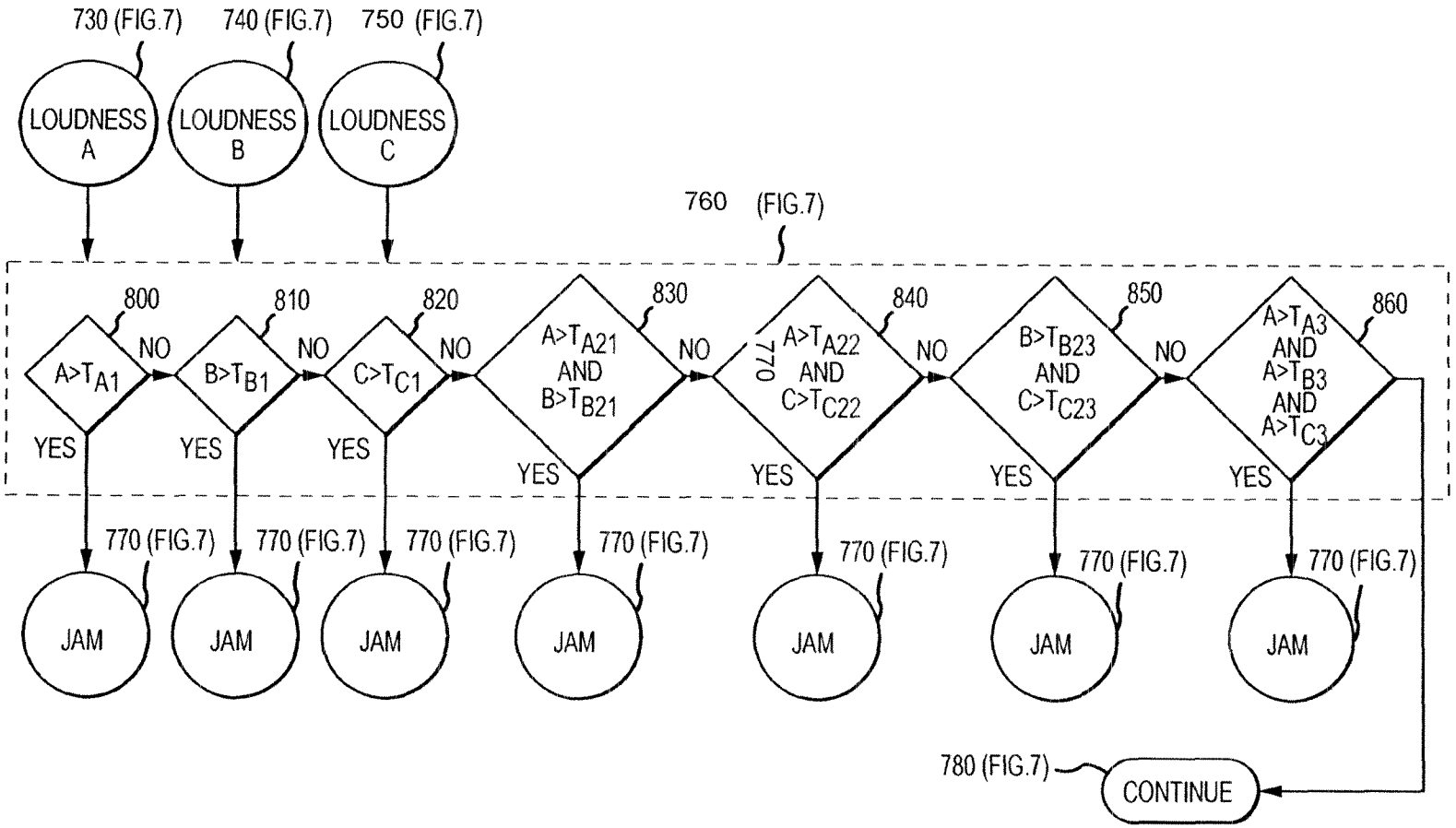
FIG. 8 is a block diagram showing additional details for the jam test block in FIG. 7.

FIG. 8 is a detailed diagram of the jam test block 760. Block 800 compares the loudness value A 730 to loudness threshold $T_{A1}$. If the loudness A 730 is greater than the loudness threshold $T_{A1}$, a jam 770 is indicated. If the loudness value A 730 is not greater than the threshold $T_{A1}$ then the jam test moves to block 810 which compares the loudness value B 740 to loudness threshold $T_{B1}$.

If the loudness value B 740 is greater than the loudness threshold $T_{B1}$, a jam 770 is indicated. If the loudness value B 740 is not greater than the loudness threshold $T_{B1}$ then the jam test moves to block 820 which compares the loudness value C 750 to loudness threshold $T_{C1}$.

If the loudness value C 750 is greater than the loudness threshold $T_{C1}$, a jam 770 is indicated. If the loudness value C 750 is not greater than the loudness threshold $T_{C1}$ then the jam test moves to block 830 which compares the loudness value A 730 to loudness threshold $T_{A21}$ and compares the loudness value B 740 to loudness threshold $T_{B21}$.

If the loudness value A 730 is greater than the loudness threshold $T_{A21}$ and loudness value B 740 is greater than loudness threshold $T_{B21}$, a jam 770 is indicated. If the loudness value A 730 is not greater than the loudness threshold $T_{A21}$, or loudness value B 740 is not greater than the loudness threshold $T_{B21}$ then the jam test moves to block 840 which compares the loudness value A 730 to loudness threshold $T_{A22}$ and loudness value C 750 to loudness threshold $T_{C22}$.

If the loudness value A 730 is greater than the loudness threshold $T_{A22}$ and loudness value C 750 is greater than loudness threshold $T_{C22}$, a jam 770 is indicated, if the loudness value A 730 is not greater than the loudness threshold $T_{A22}$, or loudness value C 750 is not greater than the loudness threshold $T_{C22}$, then the jam test moves to block 850 which compares the loudness value B 740 to loudness threshold $T_{B23}$ and loudness value C 750 to loudness threshold $T_{C23}$.

If the loudness value B 740 is greater than the loudness threshold $T_{B23}$ and loudness value C 750 is greater than loudness threshold $T_{C23}$, a jam 770 is indicated. If the loudness value B 740 is not greater than the loudness threshold $T_{B23}$, or loudness value C 750 is not greater than the loudness threshold $T_{C23}$ then the jam test moves to block 860 which compares the loudness value A 730 to loudness threshold $T_{A3}$, loudness value B 740 to loudness threshold $T_{B3}$ and loudness value C 750 to loudness threshold $T_{C3}$.

If the loudness value A 730 is greater than the loudness threshold $T_{A3}$ and loudness value B 740 is greater than loudness threshold $T_{B3}$, and loudness value C 750 is greater than loudness threshold $T_{C3}$, a jam 770 is indicated. If the loudness value A 730 is not greater than the loudness threshold $T_{A3}$, or the loudness value B 740 is not greater than the loudness threshold $T_{B3}$, or the loudness value C 750 is not greater than the loudness threshold $T_{C3}$ then the jam test moves to continue 780.

In a document scanner, many jams are the result of poor preparation where the operator does not ensure that the multiple hardcopy media 115 are attached together before it is placed into the input tray 110. The hardcopy media 115 can be attached together with staples, paper clips or adhesive. Other examples of how the hardcopy media 115 can be attached together will be evident to those skilled in the art.

A hardcopy media jam is most likely to occur when the top hardcopy medium 117 is being selected from the stack of hardcopy media 115 in the input tray 110 by the feed module 225 and is being fed into the media transport path 290 by the feed roller 223. During this time the third microphone 200*c* is ideally positioned for detecting a media jam behind the feed roller 223. Once the lead-edge of the top hardcopy medium 117 passes the take-away roller 260 the probability of a media jam is reduced. As the trail-edge of the top hardcopy medium 117 approaches urging roller 120 the chance of a trail-edge jam begin increasing. During this time the first microphone

200*a* and the second microphone 200*b* are ideally positioned for detecting a media jam along the trail-edge of the top hardcopy medium 117.

As the trail-edge of a hardcopy media passes the feed module 225, the trail edge of the hardcopy media may make a snapping sound that creates a sharp impulse in the sound signal value C 570. This sharp impulse may be referred to as the trail-edge snap. To reduce the probability of false jam detection on the trail-edge, the compute maximum loudness block 720 favors regions A, B and C of the sound profile C 650 while weighting the sound values C 570 from the other regions less. This effectively creates a low sensitivity region as the top hardcopy medium 117 is transported though the media transport path 290. The compute maximum loudness blocks 700 and 710 favor regions C, D and E of the sound profile A 630 and sound profile B 640 which allows trail-edge media jams to be detected without increasing the risk of false jams due the trail-edge snap as it passes over the point of feeding at the contact between feed rollers 223 and the separator rollers 220.

Figure 10:
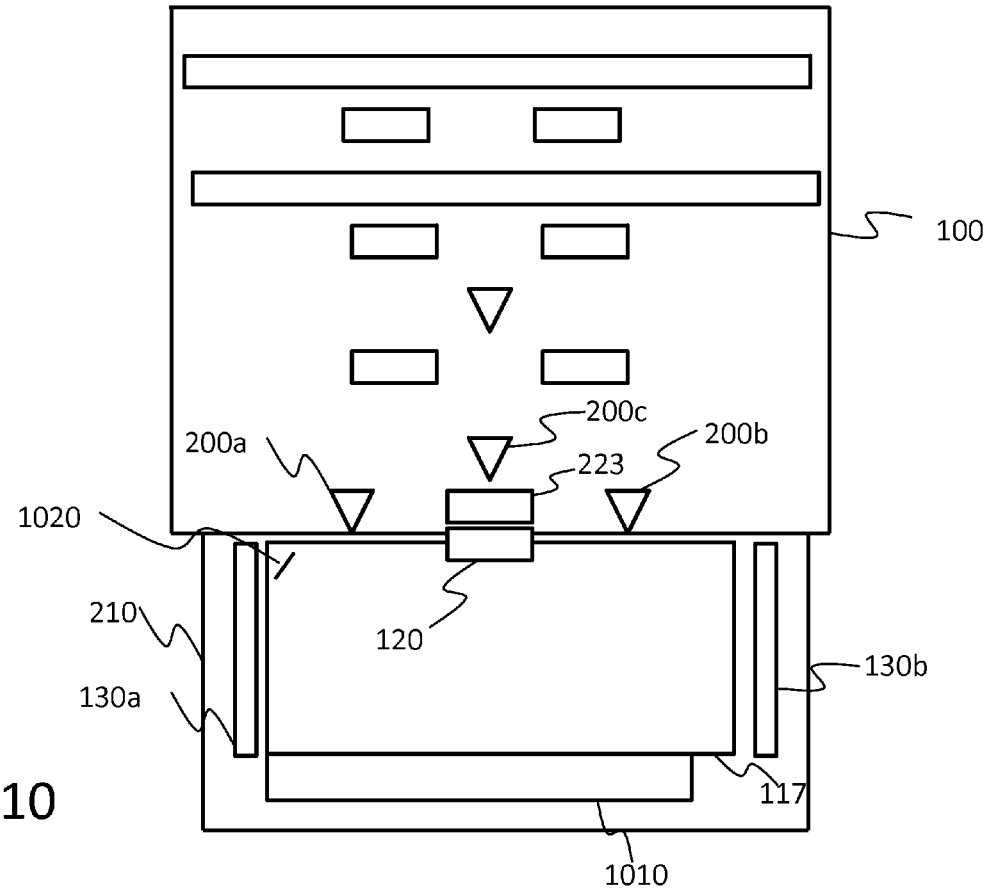
FIG. 10 is an illustration showing hardcopy medium with a staple in the lead-edge.
Figure 11:
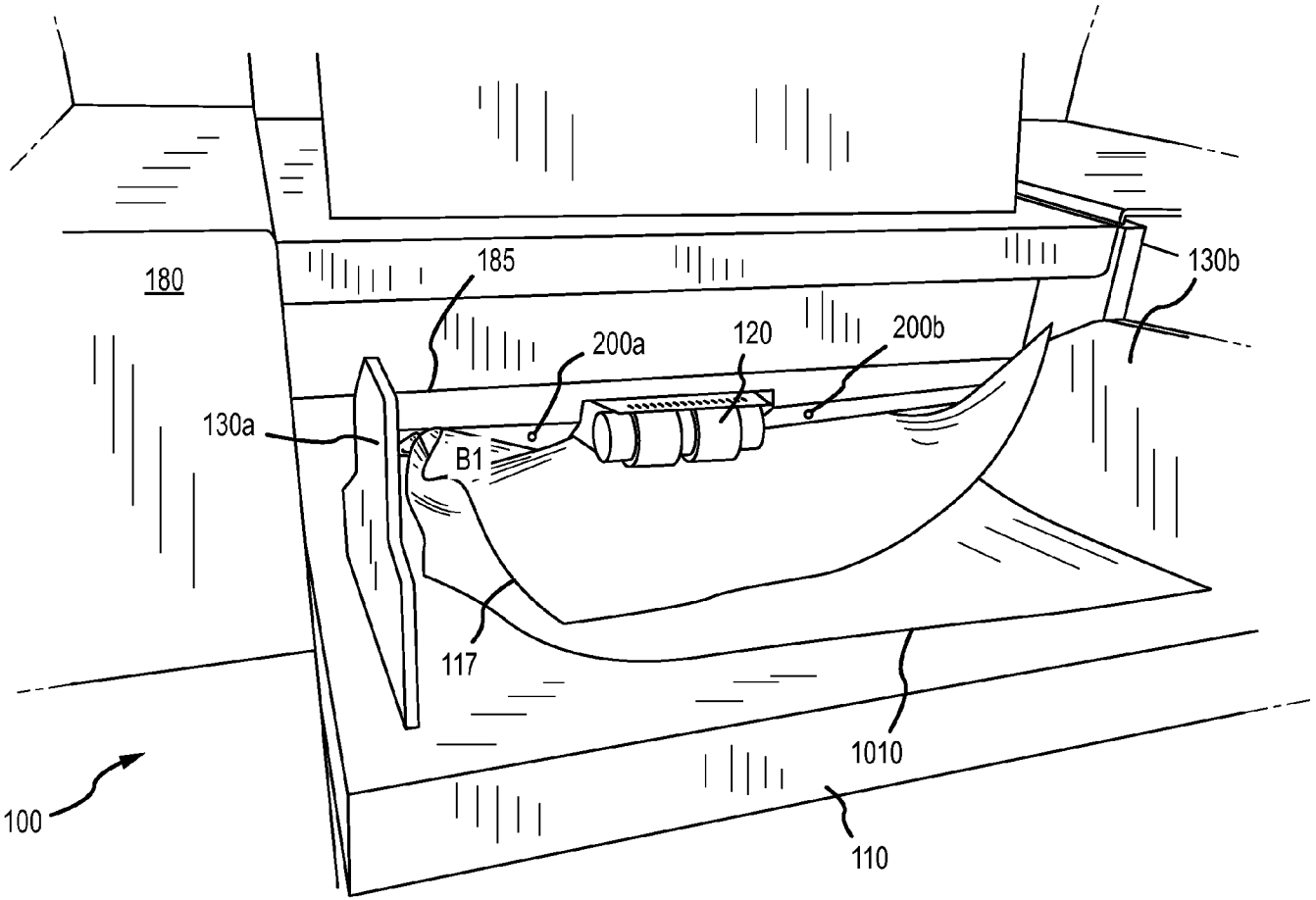
FIG. 11 is an illustration showing hardcopy medium jam due to a staple in the lead-edge.

FIG. 10 shows the top hardcopy media 117 attached on the lead-edge to the next hardcopy medium 1010 by staple 1020. When the top hardcopy media 117 is attached on the lead-edge with a staple, for example, the urging roller 120 pulls the top hardcopy medium 117 off the stack of the hardcopy media 115 in the input tray 110. The feed roller 223 pulls the top hardcopy medium 117 into the media transport path while the separator roller 220 prevents the next hardcopy medium 1010 from entering the media transport path. Since the top hardcopy medium 117 is attached to the next hardcopy medium 1010 on the lead-edge, the next hardcopy medium 1010 starts to be pulled into the media transport path 290 at the point where the staple 1020 attaches the top hardcopy medium 117 to the next hardcopy medium 1010. At the same time separator roller 220 is applying force to the next hardcopy media 1010 in the opposite direction. This opposite force causes the top hardcopy medium 117 to buckle at the staple 1020 and around the feed roller 223 as shown in FIG. 11 where the buckling is labeled B1. This buckling B1 of the top hardcopy medium 117 creates noise that is picked up by the microphone 200*c*. The bucking location of the top hardcopy medium 117 can be determined by checking the loudness detected by microphone 200*a* and 200*b*. If the top hardcopy medium 117 is stapled on the left then microphone 200*a* detects an increase in loudness. Likewise, if the staple is on the right then microphone 200*b* detects increase in loudness. If the buckling of the top hardcopy medium 117 is significant then microphone 200*a* or microphone 200*b* will detect the jam because microphone 200*a* or microphone 200*b* have a higher loudness value than microphone 200 C.

Figure 12:
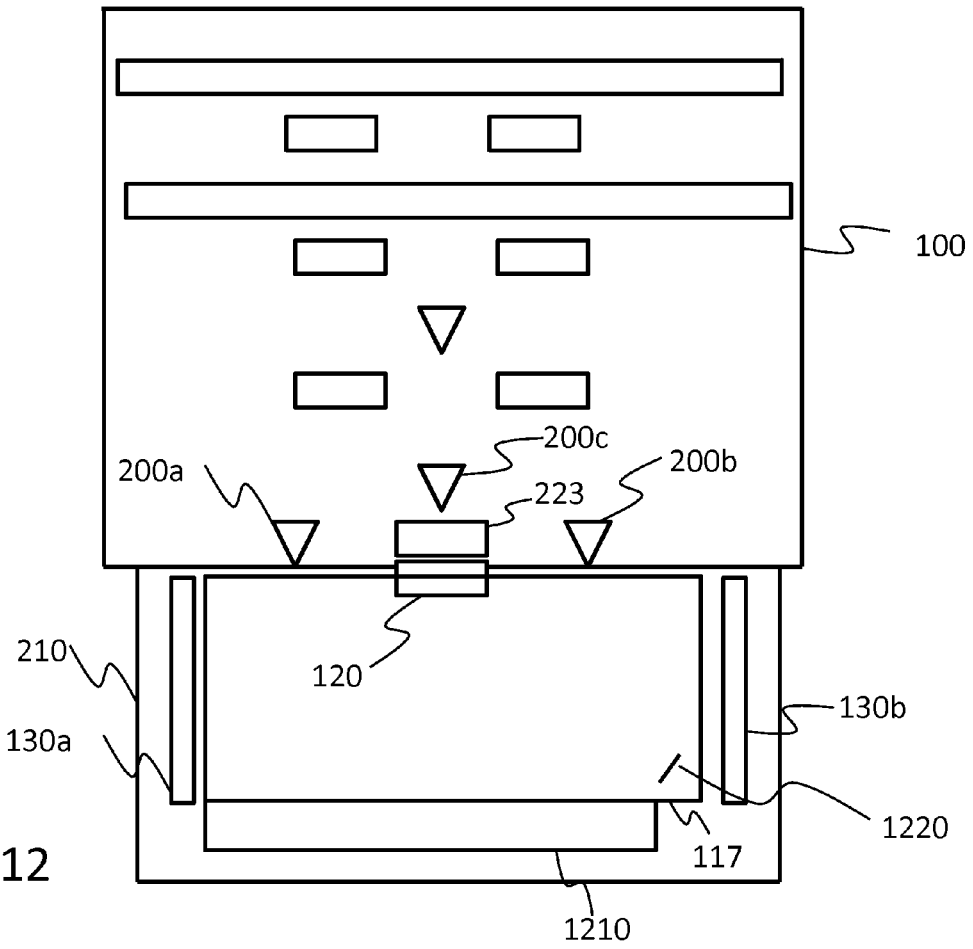
FIG. 12 is an illustration showing hardcopy medium with a staple in the trail-edge.

FIG. 12 shows top hardcopy media 117 attached on the trail-edge to the next hardcopy media 1210 by staple 1220. When the top hardcopy media 117 is attached on the trail-edge with a staple, for example, the urging roller 120 pulls the top hardcopy medium 117 off the stack of the hardcopy media 115 in the input tray 110. The feed roller 223 pulls the top hardcopy medium 117 into the media transport path 290 while the separator roller 220 prevents the next hardcopy media 1210 from entering the media transport path 290. The top hardcopy media 117 slides over the next hardcopy media 1210 as it enters the media transport path 290.

Figure 13:
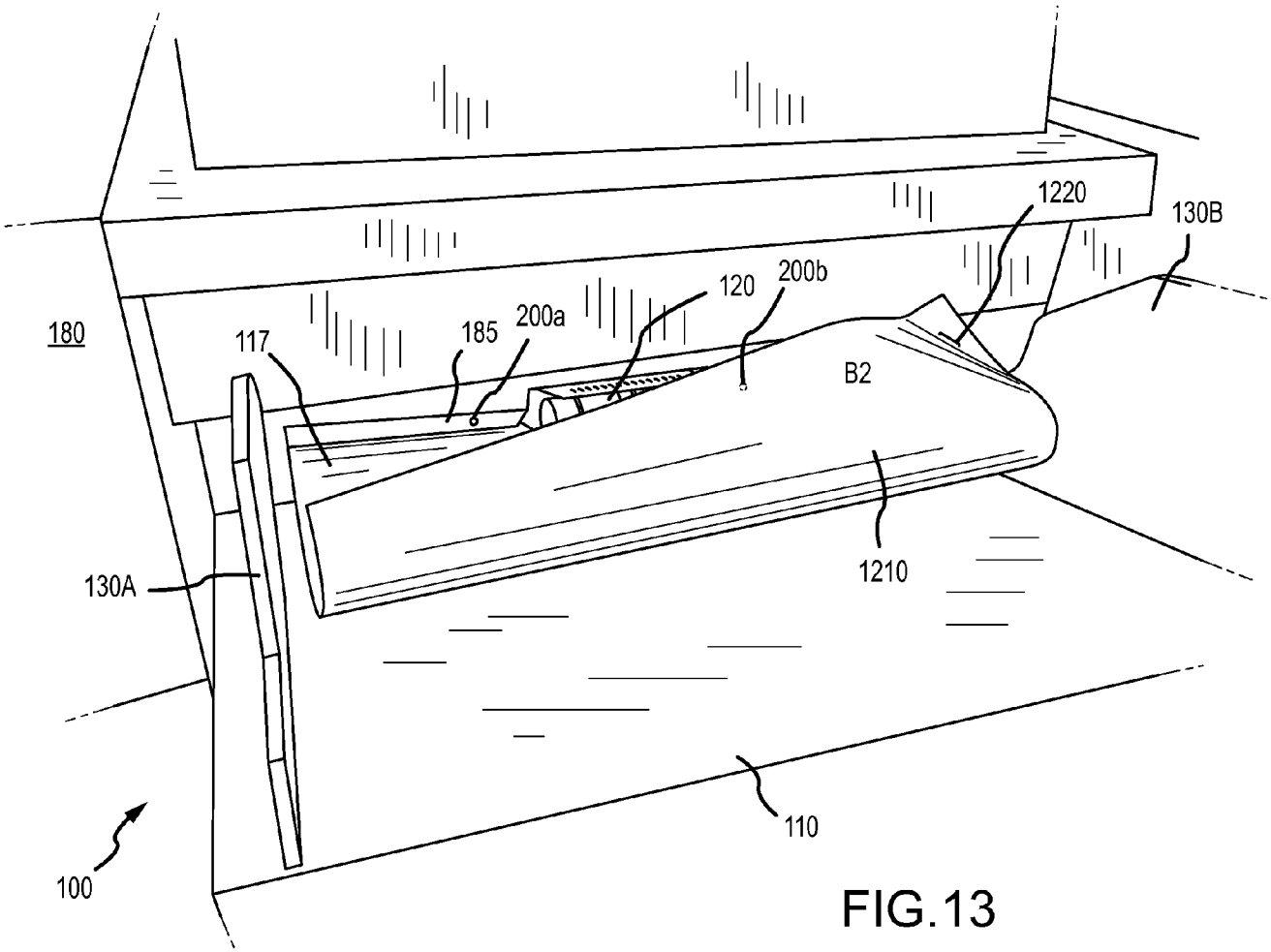
FIG. 13 is an illustration showing hardcopy medium jam due to a staple in the trail-edge.

Since the top hardcopy medium 117 is attached to the next hardcopy media 1210 on the trail-edge, the trail-edge of the top hardcopy medium 117 starts to pull the trail-edge of the next hardcopy media 1210 towards the media transport path 290. This has the effect of lifting up the trail-edge of the top hardcopy medium 117 and the next hardcopy media 1210 at the staple 1220. As top hardcopy medium 117 is pulled further into the media transport path 290 the trail-edge of top hardcopy medium 117 and the next hardcopy media 1210 at the staple 1220 strikes the delta wing at labeled B2 as shown in FIG. 13 causing a sound to be picked up by microphone 200*a* or microphone 200*b*. The location staple 1220 can be determined by the microphone that detected the jam. Typically if the staple is on the left then microphone 200*a* detects the jam. Likewise, if the staple is on the right then microphone 200*b* detects the jam.

The distance that the lead-edge of the top hardcopy medium 117 travels into the media transport path 290 and the distance the staple is located from the lead-edge can be determined by monitoring the second media sensor 210 along with the ultrasonic sensor 280. This can be used to provide additional information regarding how the top hardcopy medium 117 is bound to the hardcopy media below it. For example, if the trail-edge of top hardcopy medium 117 is attached to the next hardcopy media 1210 then the machine controller 430 could signal the transport driver unit 465 to reverse the motors to so that rollers return the top hardcopy medium 117 and the next hardcopy media 1210 to the input tray 110.

Over time the sound profiles 630, 640, 650 as shown in FIG. 6 change as the mechanical components of the medium transport system 10 wear. For example, the sound profiles may become louder as the parts wear and generate more noise within the medium transport system. When this occurs, the system may provide an audible or visual alert to the operator that maintenance or replacement of parts may be required. To detect or compensate for additional noise introduced by mechanical components, a calibration procedure can be implemented within the medium transport system 10. In region A of sound profiles 630, 640, 650, the urging roller 120 has not started to urge the top hardcopy medium 117 into the feed roller 223. The sound values A 550, B 560, and C 570 within region A of FIG. 6 are used detect any changes in the mechanical components of the medium transport system 10 as well as changes in the microphone sound pickup. In an alternative, the gap between two consecutive top hardcopy medium 117 could be used. In this case, the sound values A 550, B 560, and C 570 can be used after the trail-edge of the top hardcopy medium 117 has passed the first media sensor 205 as indicted by the first media detection signal.

Figure 9:
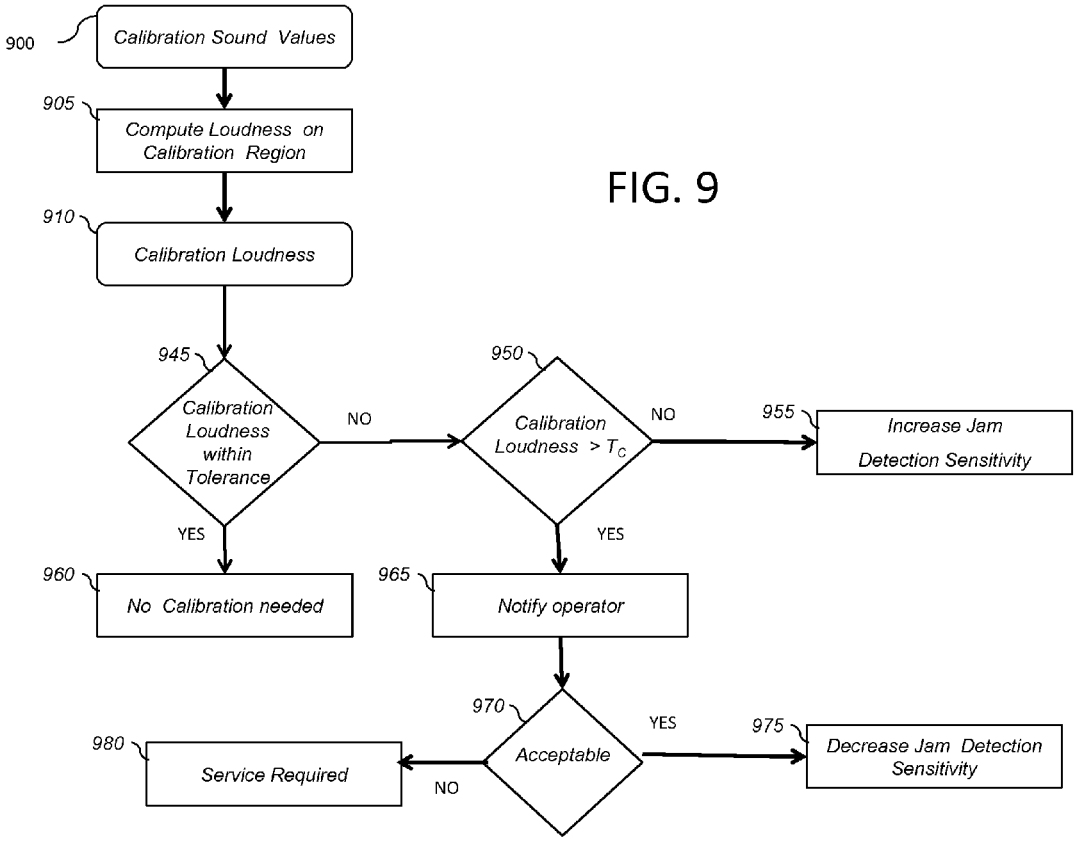
FIG. 9 is an illustration showing a calibration procedure that may be performed.

FIG. 9 is an example of a flowchart for a calibration process in the preferred embodiment for a single microphone. The calibration process may be applied to each microphone individually, or may be applied to groups of microphones. A compute maximum loudness on calibration region block 905 produces calibration loudness 910 from the sound values 900 that represent the sound values from region A of FIG. 6 of the microphone. The size of region A of FIG. 6 may contain a limited samples to perform an effective calibration so the multiple sound profiles can be concatenated together before being fed into the calibration process. Block 945 determines if the calibration loudness 910 is within an acceptable tolerance range. The acceptable range is typically ±50 ADC steps from the default calibration value stored in system memory 455, or a certain percentage of the full scale of the ADC. Note that each microphone 200*a*, 200*b* and 200*c* can have a different default calibration value stored in system memory 455. If the calibration loudness is within an acceptable range then processing continues to block 960 where no calibration is needed. If the calibration loudness 910 is not with the acceptable range then processing continues to block 950 which determines if the calibration loudness 910 is greater than the default calibration value $T_C$ stored in system memory 455. If the calibration loudness 910 is not greater than the default calibration value $T_C$ then the microphone is picking up less sound than previously used in the sound jam processing. To compensate for the reduction in the calibration loudness 910, the threshold values used by the sound jam detection processing for that microphone are decreased in block 955 to the increase the sensitivity of sound jam detector 450. If the calibration loudness is greater than the default calibration value then the medium transport system 10 is getting louder. This could be the result of a mechanical part becoming worn and is in need of replacement or there is a change in the sensitivity of the microphone. The operator is notified in block 965 and has the option to accept the change in calibration loudness 910 in block 970. If the operator does not accept the change in calibration loudness 910 then the medium transport system 10 requires servicing as shown in block 980. If the operator accepts the increase in calibration loudness 910 then the microphone is picking up more sound than previous. To compensate for the increase in the calibration loudness 910, the threshold values used by the sound jam detection processing for that microphone are increased in block 975 to the decrease the sensitivity of sound jam detector 450.

The initial thresholds $T_{A1}$, $T_{B1}$, $T_{C1}$, $T_{A21}$, $T_{B21}$, $T_{A22}$, $T_{C22}$, $T_{B23}$, $T_{C23}$, $T_{A3}$, $T_{B3}$ and $T_{C3}$ may be computed through a training process. The sound profiles 630, 640 and 650 of the sound values from microphones 200*a*, 200*b* and 200*c* are captured from the normal passage of hardcopy media 115 through the media transport path 290 to create a library of sound profiles. The library consists of a collection of sound profiles 630, 640 and 650 for $N_4$ hardcopy media 115 where $N_4$ is typically 250. The training process then analyzes the sound profile 630, 640 and 650 for each hardcopy media 115 in the library and computes the maximum sound value for microphones 200*a*, 200*b* and 200*c* over the library of sound profiles. To find the thresholds used for multiple threshold tests 830-860, the sound profiles for the microphones are compared to each other to find the sound values that produce the maximum loudness for the microphones together. The process is repeated while all but one of the microphone's sound value is held constant. While holding one microphone's sound value constant, the other microphone(s) sound profiles are searched for sound values that produce a loudness that is greater than the previous loudness found. If a greater loudness is found then that sound value for the microphone replaces the current loudness for that microphone. The process continues searching the sound profiles of each microphone while holding the other microphone sound value constant.

These maximum sound values are then used to set the thresholds $T_{A1}$, $T_{B1}$, $T_{C1}$, $T_{A21}$, $T_{B21}$, $T_{A22}$, $T_{C22}$, $T_{B23}$, $T_{C23}$, $T_{A3}$, $T_{B3}$ and $T_{C3}$. Since a library of sound profiles was created using the normal passage of hardcopy media 115 through the media transport path 290, a jam 770 would be indicted anytime the sound value A 550, B 560 and C 570 produced a loudness A 730, loudness B 740 or loudness C 750 which exceeded the threshold tests as described in FIG. 8.

The operator may put the medium transport system 10 into a training mode to allow for optimization of thresholds to match the type of hardcopy media 115 being loaded into the input tray 110. The thresholds $T_{A1}$, $T_{B1}$, $T_{C1}$, $T_{A21}$, $T_{B21}$, $T_{A22}$, $T_{C22}$, $T_{B23}$, $T_{C23}$, $T_{A3}$, $T_{B3}$ and $T_{C3}$ can be generic thresholds meaning that the thresholds will work for wide range of types of hardcopy media 115. They may also be custom thresholds meaning that thresholds $T_{A1}$, $T_{B1}$, $T_{C1}$, $T_{A21}$, $T_{B21}$, $T_{A22}$, $T_{C22}$, $T_{B23}$, $T_{C23}$, $T_{A3}$, $T_{B3}$ and $T_{C3}$ are defined for a specific type of hardcopy media 115. For example, a medium transport system 10 may be processing only 130 NCR media. In this case the training would be done using only 130 NCR media in order to optimize the thresholds for this type of media. Whenever a media transport system restricts its use to a particular set of types of media, the training may be done using only those media types to optimize the thresholds. Alternatively each microphone's thresholds may be set as a mixture of generic and custom thresholds across the entire sound profile thereby allowing the sound detection process 450 to use custom thresholds specific to a type hardcopy media in specific regions of the sound profile 630, 640 and 650.

In addition, the thresholds can be set specifically for each medium transport system 10. In this case each medium transport system 10 may produce a sound profile for hardcopy media 115 that is unique to that system. Alternatively, the thresholds $T_{A1}$, $T_{B1}$, $T_{C1}$, $T_{A21}$, $T_{B21}$, $T_{A22}$, $T_{C22}$, $T_{B23}$, $T_{C23}$, $T_{A3}$, $T_{B3}$ and $T_{C3}$ can be global thresholds meaning that the thresholds will be applied across the entire sound profile. They may also be local thresholds meaning that thresholds $T_{A1}$, $T_{B1}$, $T_{C1}$, $T_{A21}$, $T_{B21}$, $T_{A22}$, $T_{C22}$, $T_{B23}$, $T_{C23}$, $T_{A3}$, $T_{B3}$ and $T_{C3}$ are defined for a specific region A-E, thereby handling unique characteristics of the various sections of the media transport path 290. Unique characteristics of the media transport path 290 can be of any form known to those skilled in the art including, but not limited to, change in roller material, rollers speed, bends or curves within the media transport path 290.

The invention claimed is:

1. A system for calibrating jam detection components within a media transport device, the system comprising:

a transport path within the media transport device;

a plurality of rollers configured to move media along the transport path;

at least one microphone located along the transport path and configured to receive signals indicative of the noise of media being transported; and a system processing unit coupled to a memory, the system processing unit configured to:

retrieve detected sound values from the at least one microphone for a calibration region along the transport path;

compute a loudness profile from the detected sound values;

determine the maximum loudness of the detected sound values to produce a calibration loudness;

compare the calibration loudness to a default calibration value and an acceptable range to determine if it is acceptable.

2. The system of claim 1, wherein, if the calibration loudness is not within the acceptable range, the system processing unit is further configured to:

determine if the calibration loudness is greater than or less than the default calibration value.

3. The system of claim 2, wherein, if the calibration loudness is greater than the default calibration value, the system processing unit is configured to increase the default calibration value for the at least one microphone.

4. The system of claim 3, wherein the system processing unit is further configured to increase threshold loudness values stored in the memory, wherein the threshold loudness values are used to determine the presence of a jam in the media transport device.

5. The system of claim 4, wherein system processing unit is configured to determine the threshold loudness values through a training program, wherein the threshold values may be generic values for all media types or may be specific to a particular type of media being transported.

6. The system of claim 5, wherein the training program includes capturing sound profiles with the at least one microphone during normal passage of each of a plurality of types of media being transported along the transport path, storing the sound profiles within a library in the memory, computing maximum values for each sound profile in the library, and setting the maximum values as the threshold values.

7. The system of claim 2, wherein, if the calibration value is less than the default calibration, the system processing unit is configured to decrease threshold loudness values stored in the memory, wherein the threshold loudness values are used to determine the presence of a jam in the media transport device.

8. The system of claim 7, wherein system processing unit is configured to determine the threshold loudness values through a training program, wherein the threshold values may be generic values for all media types or may be specific to a particular type of media being transported.

9. The system of claim 8, wherein the training program includes capturing sound profiles with the at least one microphone during normal passage of each of a plurality of types of media being transported along the transport path, storing the sound profiles within a library in the memory, computing maximum values for each sound profile in the library, and setting the maximum values as the threshold values.

10. The system of claim 1, wherein the system processing unit is further configured to generate an audible or visual alert to an operator that maintenance or replacement of parts may be required based on a change in the loudness values.

11. A method for calibrating jam detection components within a media transport device, the system comprising:

moving media along a transport path within a media transport device;

retrieving detected sound values with a system processing unit coupled to a memory, from at least one microphone located along the transport path and configured to receive signals indicative of the noise of the media being transported, for a calibration region along the transport path;

computing a loudness profile from the detected sound values with the system processing unit;

determining the maximum loudness of the detected sound values to produce a calibration loudness with the system processing unit; and comparing, with the system processing unit, the calibration loudness to a default calibration value and an acceptable range to determine if it is acceptable.

12. The method of claim 11, wherein, if the calibration loudness is not within the acceptable range, the system processing unit further:

determines if the calibration loudness is greater than or less than the default calibration value.

13. The method of claim 12, wherein, if the calibration loudness is greater than the default calibration value, the system processing unit increases the default calibration value for the at least one microphone.

14. The method of claim 13, wherein the system processing unit increases threshold loudness values stored in the memory, wherein the threshold loudness values are used to determine the presence of a jam in the media transport device.

15. The method of claim 14, wherein the system processing unit determines the threshold loudness values through a training program, wherein the threshold values may be generic values for all media types or may be specific to a particular type of media being transported.

16. The method of claim 15, wherein the training program includes capturing sound profiles with the at least one microphone during normal passage of each of a plurality of types of media being transported along the transport path, storing the sound profiles within a library in the memory, computing maximum values for each sound profile in the library, and setting the maximum values as the threshold values.

17. The method of claim 12, wherein, if the calibration value is less than the default calibration the system processing unit decreases threshold loudness values stored in the memory, wherein the threshold loudness values are used to determine the presence of a jam in the media transport device.

18. The method of claim 17, wherein the system processing unit determines the threshold loudness values through a training program, wherein the threshold values may be generic values for all media types or may be specific to a particular type of media being transported.

19. The method of claim 18, wherein the training program includes capturing sound profiles with the at least one microphone during normal passage of each of a plurality of types of media being transported along the transport path, storing the sound profiles within a library in the memory, computing maximum values for each sound profile in the library, and setting the maximum values as the threshold values.

20. The method of claim 11, wherein the system processing unit generates an audible or visual alert to an operator that maintenance or replacement of parts may be required based on a change in the loudness values.

* * * * *